US005820267A

United States Patent [19]

Nobles

[11] Patent Number: 5,820,267

[45] Date of Patent: Oct. 13, 1998

[54] SECURITY LOCKING BAG WITH LOCKING SECURITY REINFORCEMENT SHIELD

[75] Inventor: Columbus Nobles, Bristol, Tenn.

[73] Assignee: Block and Company, Inc., Wheeling, Ill.

[21] Appl. No.: 134,284

[22] Filed: Oct. 8, 1993

[51] Int. Cl.[6] ..... B65D 33/17

[52] U.S. Cl. ..... 383/97; 70/68; 206/0.82; 206/1.5; 383/105

[58] Field of Search ..... 206/0.8, 0.81–0.84, 206/1.5; 70/64–68; 292/57, 60; 383/97, 105, 903

[56] References Cited

U.S. PATENT DOCUMENTS

| | | | |
|---|---|---|---|
| 1,950,414 | 3/1934 | Rifkin | 70/68 |
| 1,950,415 | 3/1934 | Rifkin | 70/68 |
| 3,580,016 | 5/1971 | Kerr | 70/68 |
| 3,653,236 | 4/1972 | Kerr | 70/68 |
| 3,759,073 | 9/1973 | Rifkin | 70/68 |
| 4,019,353 | 4/1977 | Christopher | 70/68 |
| 4,062,207 | 12/1977 | Bonner | 70/68 |
| 4,821,539 | 4/1989 | Steinbach | 70/68 |
| 5,013,162 | 5/1991 | Williams et al. | 383/97 |

OTHER PUBLICATIONS

Sample A —Block & Company "Ultima Seven" Advertising and Product Photocopies No Date.
Sample B —Photocopy of Commercial Bag No Date.
Sample C —Photocopies of Commercial Bag No Date.

*Primary Examiner*—Jimmy G. Foster
*Attorney, Agent, or Firm*—Gomer W. Walters

[57] ABSTRACT

The present invention provides a security locking bag for holding currency and coin comprising a fabric bag open along one side, the open side of the bag having a lock end and a zipper end. A zipper is attached to the fabric bag along the open side of the bag to allow the open side of the bag to be closed by pulling a sliding piece. A lock is positioned at the lock end of the open side of the bag, the lock including a body portion and locks by capturing and retaining the sliding piece. A flexible reinforcing material is folded over onto itself, to straddle the bag at the lock end of the bag. A rigid reinforcement shield is disposed between the sides of the flexible reinforcing material. The rigid reinforcement shield is sized and shaped to conform to the size and shape of the body portion of the lock and is positioned to hold one side of the flexible reinforcing material tightly against the body portion of the lock. The metal reinforcement shield and flexible reinforcing material are secured to the body portion of the lock.

10 Claims, 2 Drawing Sheets

SECURITY LOCKING BAG WITH LOCKING SECURITY REINFORCEMENT SHIELD

BACKGROUND OF THE INVENTION

1. Field of the Invention

The present invention relates to security locking bags for holding currency and coin, and more particularly to such bags having a zippered opening and a locking mechanism for locking the zipper in the closed position.

2. Description of the Prior Art

Fabric bags for holding currency and coin, and fabric bags having zippered openings to receive the currency and coin are known in the art. It is also known in the art to provide a locking mechanism to lock the zipper in the closed position, to prevent theft of the currency and coin held within the bag.

However, problems with such prior zippered security locking bags have arisen. In particular, at the juncture of the locking mechanism and the bag, it has been possible to tamper with the bag contents without obvious damage to the bag itself by inserting a tool, such as a paper clip, between the bag and the lock. This problem is intensified after the bag has undergone wear and tear from repeated use. Frequently, such bags are used for night deposits at a financial institution, and are dropped into a night depository, such as a drawer or chute.

Due to the weight of the lock, a bag will tend to drop on the lock, and after repeated drops, the connection between the lock and the bag may be loosened, allowing for easier tampering with the bag contents upon later use. Moreover, such repeated drops may damage the lock.

One solution to the problem has been to provide a reinforcing fabric, such as an artificial leather or "naugahyde" reinforcement along the juncture of the locking mechanism and the bag, with the connection made along the artificial leather. However, this solution still allows for tampering along the juncture and does not adequately protect the locking mechanism. The artificial leather has also been doubled over, with the bag fabric positioned between layers of artificial leather, and with a thin metal band partially surrounding a portion of the main body of the lock and securing the bag, lock and artificial leather together through rivets and the like. However, this solution also does not adequately protect the lock and the juncture from damage from repeated dropping, and hence does not adequately insure that the bag will be tamper proof throughout its useful life.

SUMMARY OF THE INVENTION

An object of the present invention is to provide a zippered security locking bag that is tamper resistant.

A further object of the present invention is to provide such a security locking bag that protects the lock from damage due to repeated dropping of the bag through use.

A further object of the present invention is to provide such a security locking bag with a minimal potential for undetected incursion into the bag at the juncture of the bag and lock.

A further object of the present invention is to provide a rigid reinforcement shield for the lock of a zippered security locking bag.

A further object of the present invention is to provide a rigid reinforcement shield that minimizes the potential for undetected incursion into the bag at the juncture of the bag and the lock.

A further object of the present invention is to provide such a rigid reinforcement shield that is substantially coextensive with the main body of the lock within the interior of the bag.

A further object of the present invention is to provide such a rigid reinforcement shield that protects both the body and the plunger of the lock from shock due to repeated dropping.

A further object of the present invention is to provide such a rigid reinforcement shield that does not interfere with efficient attachment of the zipper to the bag.

In one aspect, the present invention meets these objectives by providing a bag for holding currency and coin comprising a fabric bag open along one side, the open side of the bag having a lock end and a zipper end. A zipper is attached to the fabric bag along the open side of the bag to allow the open side of the bag to be closed, the zipper including a sliding piece that is slidable between the zipper end of the open side of the bag and the lock end of the open side of the bag. A lock is positioned at the lock end of the open side of the bag, the lock including a body portion and means for capturing and retaining the sliding piece. A flexible reinforcing material is folded over onto itself, to straddle the bag at the lock end of the bag. A rigid reinforcement shield is disposed between the sides of the flexible reinforcing material, the rigid reinforcement shield being sized and shaped to conform to the size and shape of the body portion of the lock and positioned to hold one side of the flexible reinforcing material tightly against the body portion of the lock. Means for connecting the metal reinforcement shield and flexible reinforcing material to the body portion of the lock are also provided.

In another aspect, the present invention provides a locking security reinforcement shield for protecting a lock of the type having a substantially U-shaped body, the shield comprising a rigid shield having a pair of front edges, a U-shaped bottom edge, a U-shaped top edge, and two stepped edges, wherein the pair of front edges are substantially parallel to each other, the U-shaped top and bottom edges are substantially parallel to each other and perpendicular to the pair of front edges, and wherein the two stepped edges connect the ends of the U-shaped top edge to ends of the pair of front edges. The stepped edges include angled segments converging from the ends of the U-shaped top edge toward the U-shaped bottom edge and flat segments extending from the ends of the angled segments to the front edges. The flat segments are substantially perpendicular to the front edges.

In yet another aspect, the present invention provides a bag for holding currency and coin comprising a bag having an open side, the open side of the bag having a locking end and a zipper end and a pair of parallel edges. The bag also includes a zipper including a pair of rows of teeth attached along the parallel edges of the open side of the bag. The zipper also includes a sliding piece slidable between the zipper end of the open side of the bag and the locking end to close the bag. The bag further includes a lock disposed at the locking end of the open side of the bag. The lock includes a main body portion having a flat top surface, a flat front surface perpendicular to the flat lock top, a flat bottom surface and a curved U-shaped surface joining the flat top surface, flat bottom surface and the flat front surface. The lock further includes a ledge extending outwardly and perpendicularly from the flat front surface toward the zipper end of the open side of the bag and a plunger reciprocable within the main body portion of the lock in a direction parallel to the front surface of the lock. The plunger includes a shoulder extending over and spaced above the ledge. The plunger is lockable in a closed position to capture and retain the sliding piece of the zipper between the ledge and the shoulder of the plunger. The bag also comprises a piece of flexible reinforcing material folded over onto itself to define inner and outer surfaces joined by a folded edge. The outer surface of the flexible reinforcing material is attached to the bag at the locking end of the bag, and the folded edge of the flexible reinforcing material is positioned around the curved U-shaped portion of the main body portion of the lock near the top surface of the lock. The inner surface of the flexible reinforcing material surrounds the curved U-shaped portion of the main body portion of the lock and covers substantially the entire curved U-shaped portion of the main body portion of the lock. A substantially U-shaped rigid reinforcement shield surrounds the inner surface of the flexible reinforcing material. The rigid reinforcement shield substantially conforms to the shape of the U-shaped portion of the main body portion of the lock and extends from below the folded edge of the flexible reinforcing material to the bottom surface of the lock. The rigid reinforcement shield includes stepped portions extending toward the zipper end of the bag past the front surface of the main body portion of the lock. Means for connecting the metal reinforcement shield and flexible reinforcing material to the main body portion of the lock are also included.

DETAILED DESCRIPTION OF THE ILLUSTRATED EMBODIMENT

Security locking bags for depositing currency and coin typically have a zippered opening and a lock to prevent opening of the bag. The lock employed must be connected to the bag, and the juncture of the bag and lock is subject to unwanted and potentially undetected tampering. Moreover, such bags are frequently deposited by being dropped into a night depository chute; wear and tear from repeated dropping can impair the integrity of the connection between the lock and the bag, allowing for easier undetected access to the contents of the bag, and the repeated dropping can also damage the lock itself. These problems are addressed in the present invention.

Figure 1:
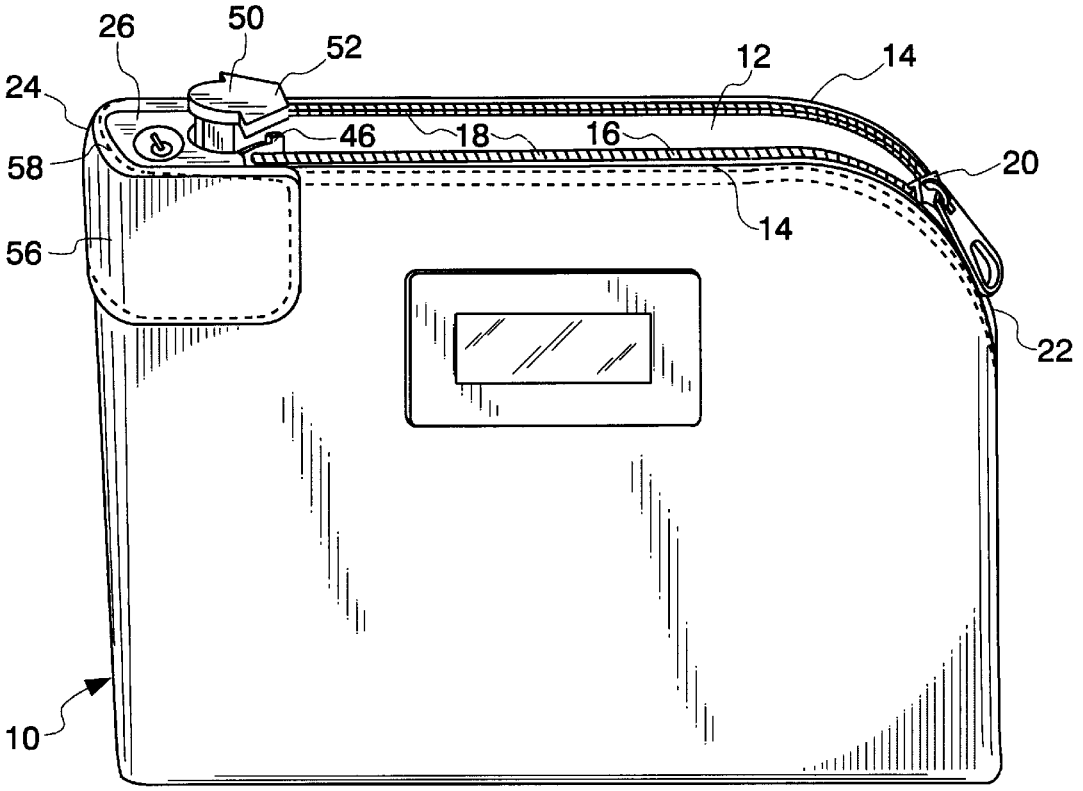
FIG. 1 is a perspective view of the security locking bag of the present invention.

Briefly, as shown in FIG. 1, the present invention provides a fabric security locking bag 10 for holding currency and coin. The bag has an open side 12 with parallel edges 14. The bag's opening has a zipper 16, comprising a pair of rows of teeth 18 and a sliding piece 20. The sliding piece 20 is slidable along the rows of teeth from a zipper end 22 to a locking end 24 of the bag to engage and disengage the rows of teeth 18 to close and open the open side 12 of the bag 10.

The security locking bag 10 also includes a lock 26 disposed at the locking end 24 of the open side 12 of the bag. A flexible reinforcing material 30 and a substantially U-shaped rigid reinforcement shield 32 surround the main body portion 34 of the lock 26.

The lock 26 is of a type known in the art and previously used to lock the zipper of such security locking bags. In the illustrated embodiment, the main body portion 34 of the lock 26 has a flat top surface 36, a flat front surface 38 and a curved U-shaped surface 40 joining the flat top 36 and flat front 38. The flat front 38 and flat top 36 are perpendicular to each other, and a flat bottom surface 42 is parallel to the flat top 36. A ledge 44 extends outwardly and perpendicularly from the flat front 38 below the flat top 36, toward the zipper end 22 of the bag. The ledge 44 has a pair of upstanding protuberances 46 at its front edge 47 converging toward the zipper end 22 of the bag and may define a recess shaped to match the shape of the sliding piece 20 of the zipper. The lock also has a plunger 50 reciprocable within the main body portion 34 of the lock in a direction parallel to the flat front 38 of the main body 34. The plunger 50 has a shoulder 52 extending over and above the ledge 44. The plunger may thus be reciprocated to and locked in a closed position, to capture and retain the sliding piece 20 of the zipper 16 between the shoulder 52 of the plunger 50 and the ledge 44. Together, the plunger and ledge comprise a means for capturing and retaining the sliding piece. When unlocked, the plunger springs upward, freeing the zipper's sliding piece 20 so that the bag may be opened.

The lock 26 is joined to the bag 10 at the locking end 24 of the bag opening 12 through the sheet of flexible reinforcing material 30. In the illustrated embodiment, the flexible reinforcing material comprises a sheet of artificial leather, such as that sold under the trade name "naugahyde," and should, as will be understood by those skilled in the art, be made of a material that can be sewn, and that is durable and relatively impervious. In the present invention, the flexible reinforcing material is folded over onto itself to define integral inner and outer sheets 54, 56 joined by a folded edge 58. The outer sheet 56 is attached to the bag fabric at the locking end 24 of the bag by stitching along the periphery of the outer sheet, and the folded edge 58 extends over a portion of both parallel edges 14 of the open side 12 of the bag 10 at the locking end 24. The inner sheet 54 is positioned tightly around the curved U-shaped surface 40 of the main body 34 of the lock 26, between the curved U-shaped surface 40 of the lock and the rigid reinforcement shield 32. The folded edge 58 is positioned substantially at or just below the top surface 36 of the main lock body 34. The outer sheet 56 has front edges 59 which extend past the flat front 38 of the main lock body 34, substantially to or past the front edge 47 of the ledge 44.

The rigid reinforcement shield 32 is substantially U-shaped, and is shaped to closely conform to the shape of the curved U-shaped surface 40 of the main body 34 of the lock 26. The rigid reinforcement shield 32 includes a pair of countersunk apertures 60, which correspond with countersunk apertures 62 in the main body portion 34 of the lock 26. Threaded bolts 64 or rivets extending through the apertures 60, 62 and through apertures in the flexible reinforcing material 30 may be used as a means for connecting the metal reinforcement shield and flexible reinforcing material to the body portion of the lock.

Figure 4:
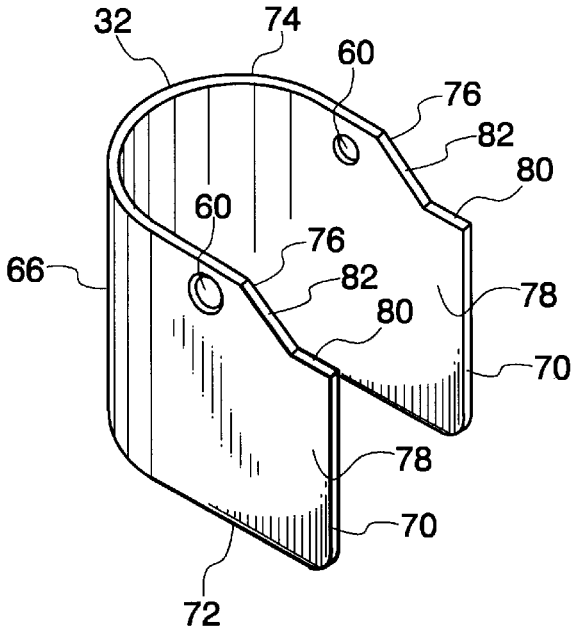
FIG. 4 is a perspective view of the rigid reinforcement shield of the present invention.
Figure 5:
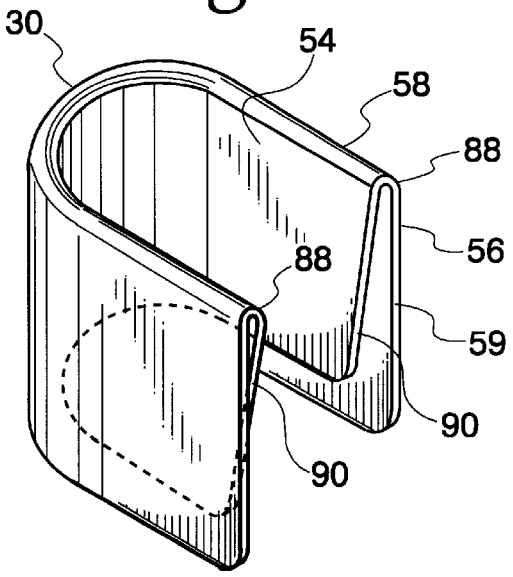
FIG. 5 is a perspective view of the flexible reinforcing material of the present invention, folded and shaped to conform to the lock body.

As illustrated in FIG. 4, the rigid reinforcement shield 32 has a curved U-shaped body 66 with a pair of front edges 70, a U-shaped bottom edge 72, a U-shaped top edge 74 and a pair of stepped edges 76. The front edges 70 are parallel to each other and perpendicular to the top 74 and bottom 72 edges. The U-shaped top edge 74 is positioned substantially at or just below the flat top 36 of the main lock body 34. The U-shaped bottom edge 72 is positioned substantially at the flat bottom 42 of the main lock body 34.

Figure 2:
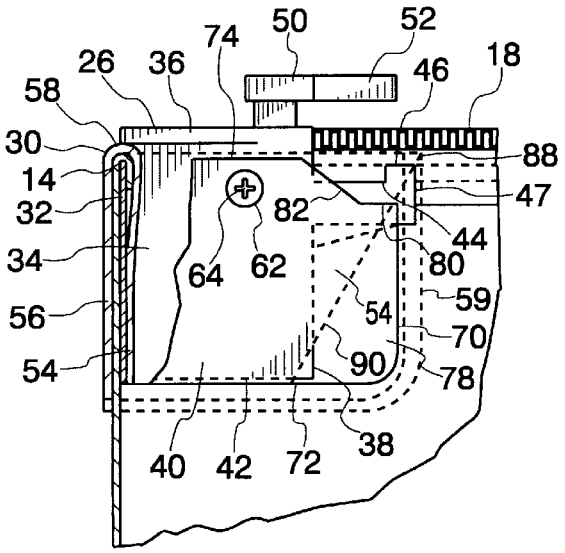
FIG. 2 is an enlarged side view of the lock end of the bag of the present invention, with parts removed for clarity of illustration.
Figure 3:
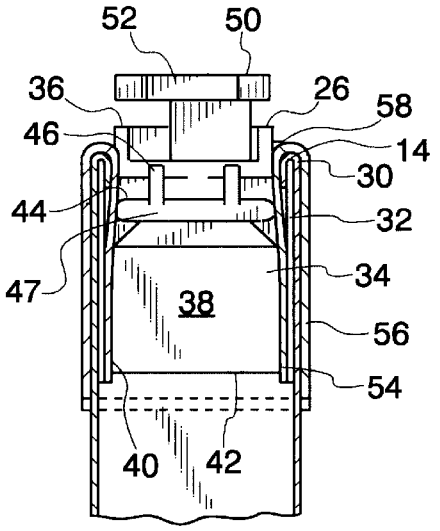
FIG. 3 is an enlarged front view of the lock end of the bag of the present invention, with parts removed for clarity of illustration.

Each stepped edge 76 extends from an end of the U-shaped top edge 74 to the pair of front edges 70. The stepped edges 76 include flat segments 80 and angled segments 82 extending between the flat segments 80 and the ends of the U-shaped top edge 74. The angled segments 82 converge from the ends of the U-shaped top edge 74 downwardly toward the U-shaped bottom edge 72 of the rigid reinforcement shield 32. The flat segments 80 extend from the ends of the angled segments 82 to the pair of front edges 70. The flat segments 80 are substantially perpendicular to the pair of front edges 70. As shown in FIGS. 2 and 4, the stepped portions 78 of the shield, extending downwardly from the stepped edges 76, extend toward the zipper end 22 of the bag, and extend past the flat front 38 of the main body of the lock. Thus, the front edges 70 of the shield are disposed between the flat front 38 of the main body and the free front edge 47 of the ledge 44. As shown in FIG. 2, the flat segments 80 of the stepped edges 76 are above, or substantially at, the level of the ledge's 44 bottom edge so that the flat segments cover at least a portion of the ledge. So configured, the rigid shield protects the ledge from damage from repeated dropping of the bag.

Also as shown in FIG. 2, the rigid reinforcement shield 32 is wide enough, between the U-shaped top and bottom edges 72, 74, to cover the entire curved U-shaped surface 40 of the main body 34 portion of the lock 26. Thus, the rigid reinforcement shield not only firmly attaches the bag, lock and flexible reinforcing material together, but also protects the main body portion of the lock from shock from repeated dropping, and holds the flexible reinforcing material tightly against the main body portion of the lock, to make it more difficult for a would-be tamperer to force a tool between the lock and the flexible reinforcing material.

Figure 6:
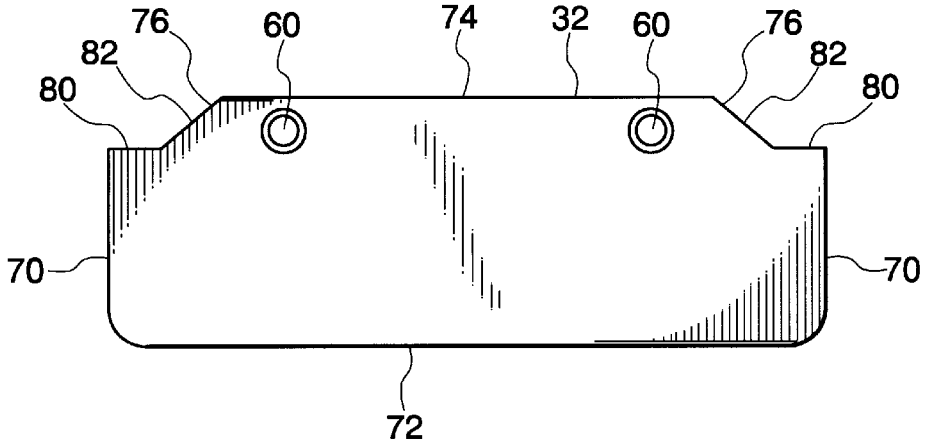
FIG. 6 is a plan view of the rigid reinforcement shield prior to being shaped to match the shape of the main body portion of the lock.

As shown in FIG. 6, the rigid reinforcement shield 32 may be formed from a flat sheet of material, cut or stamped into the desired configuration, and then bent into the desired shape, such as in the illustrated U-shape. In the illustrated embodiment, the rigid reinforcement shield is a metal.

The shape of the rigid reinforcement shield 32 depends upon the shape of the main lock body 34. The size and shape of the rigid reinforcement shield should at least closely conform to the size and shape of the main lock body. It should be sized to be at least substantially coextensive with the main lock body. Preferably, the rigid reinforcement shield is shaped and sized so that it extends past the flat front 38 of the main body of the lock, to cover a portion of the ledge 44 to protect the ledge from damage.

The flexible reinforcing material 30 is preferably substantially coextensive with the rigid reinforcing shield. As shown in FIG. 2, the folded edge 58 of the flexible reinforcing material 30 has two ends 88 which extend past the front surface 38 of the main lock body 34. Preferably, the ends 88 of the folded edge of the flexible reinforcing material extend at least to the junctures of the flat segments 80 of the stepped edges 76 and the front edges 70 of the rigid reinforcement shield. For ease in manufacture, and in particular for ease in stitching the mating strips of fabric holding the rows of zipper teeth 18 to the bag, the flexible reinforcing material may have tapering front edges 90 as shown in FIG. 2, so that the front edges 90 of the inner sheet 54 of the flexible reinforcing material angle toward the front surface 38 of the main body portion 34 of the lock.

The front edges 90 of the inner sheet of the flexible reinforcement material extend from the ends 88 of the folded edge 58 of the flexible reinforcing material 30 toward the front surface 38 of the main body portion of the lock. The stepped edges 76 of the rigid reinforcement shield 32 similarly allow for easier manufacture. In the illustrated embodiment, the junctures of the U-shaped top edge 74 of the rigid reinforcement shield 32 and the angled segments 82 of the stepped edges are rearward of the front surface 38 of the main body of the lock, and the junctures of the angled segments 82 and flat segments 80 is forward of the front surface 38 of the main body of the lock.

Although the invention has been described with respect to a preferred embodiment, it will be understood by those skilled in the art that the invention is not limited to that particular embodiment, and that some changes may be made without departing from the invention as set forth in the claims.

I claim:

1. A bag for holding currency and coin comprising:

a fabric bag open along one side, the open side of the bag having a lock end and a zipper end;

a zipper attached to the fabric bag along the open side of the bag to allow the open side of the bag to be closed, the zipper including a sliding piece that is slidable between the zipper end of the open side of the bag and the lock end of the open side of the bag;

a lock positioned at the lock end of the open side of the bag, the lock including a body portion and means for capturing and retaining the sliding piece;

a flexible reinforcing material secured to the fabric bag and folded over onto itself to form opposing sides that straddle the bag fabric at the lock end of the bag;

a rigid reinforcement shield disposed between the sides of the flexible reinforcing material, the rigid reinforcement shield being sized and shaped to conform to the size and shape of the body portion of the lock and positioned to hold one side of the flexible reinforcing material tightly against the body portion of the lock; and means for connecting the rigid reinforcement shield and flexible reinforcing material to the body portion of the lock.

2. A bag for holding currency and coin comprising:

a fabric bag open along one side, the open side of the bag having a lock end and a zipper end;

a zipper attached to the fabric bag along the open side of the bag to allow the open side of the bag to be closed, the zipper including a sliding piece that is slidable between the zipper end of the open side of the bag and the lock end of the open side of the bag;

a lock positioned at the lock end of the open side of the bag, the lock including a body portion having a front surface and means for capturing and retaining the sliding piece, the means for capturing and retaining the sliding piece including a ledge extending outwardly and perpendicularly from the front surface of the body portion of the lock and a plunger reciprocable in the body portion of the lock in a direction parallel to the front surface of the body portion of the lock, the plunger including a shoulder extending over and spaced from the ledge;

a flexible reinforcing material folded over onto itself to form opposing sides that straddle the bag at the lock end of the bag;

a rigid reinforcement shield disposed between the sides of the flexible reinforcing material, the rigid reinforcement shield being sized and shaped to conform to the size and shape of the body portion of the lock so that it extends past the front surface of the body portion of the lock, to cover a portion of the ledge, the rigid reinforcement shield being positioned to hold one side of the flexible reinforcing material tightly against the body portion of the lock; and means for connecting the rigid reinforcement shield and flexible reinforcing material to the body portion of the lock.

3. A bag as claimed in claim 2 wherein the rigid reinforcement shield includes stepped portions extending toward the zipper end of the bag past the front surface of the body portion of the lock.

4. A bag as claimed in claim 2 wherein the flexible reinforcing material is substantially coextensive with the rigid reinforcing shield.

5. A bag as claimed in claim 2 wherein the flexible reinforcing material has a pair of tapering front edges extending toward the front surface of the body portion of the lock.

6. A locking security reinforcement shield for protecting a lock of the type having a substantially U-shaped body, the shield comprising a rigid shield having a pair of front edges, a U-shaped bottom edge, a U-shaped top edge, and two stepped edges, wherein the pair of front edges are substantially parallel to each other, the U-shaped top and bottom edges are substantially parallel to each other and perpendicular to the pair of front edges, and wherein the two stepped edges connect the ends of the U-shaped top edge to ends of the pair of front edges, the stepped edges including angled segments converging from the ends of the U-shaped top edge toward the U-shaped bottom edge and flat segments extending from the ends of the angled segments to the front edges, the flat segments being substantially perpendicular to the front edges.

7. A bag for holding currency and coin comprising:

a bag having an open side, the open side of the bag having a locking end and a zipper end and a pair of parallel edges;

a zipper including a pair of rows of teeth attached along the parallel edges of the open side of the bag, the zipper also including a sliding piece slidable between the zipper end of the open side of the bag and the locking end to close the bag;

a lock disposed at the locking end of the open side of the bag, the lock including a main body portion having a flat top surface, a flat front surface perpendicular to the flat lock top, a flat bottom surface and a curved U-shaped surface joining the flat top surface, flat bottom surface and the flat front surface, the lock further including a ledge extending outwardly and perpendicularly from the flat front surface toward the zipper end of the open side of the bag and a plunger reciprocable within the main body portion of the lock in a direction parallel to the front surface of the lock, the plunger including a shoulder extending over and spaced above the ledge, the plunger being lockable in a closed position to capture and retain the sliding piece of the zipper between the ledge and the shoulder of the plunger;

a piece of flexible reinforcing material folded over onto itself to define inner and outer surfaces joined by a folded edge, the outer surface of the flexible reinforcing material being attached to the bag at the locking end of the bag, the folded edge of the flexible reinforcing material being positioned around the curved U-shaped portion of the main body portion of the lock near the top surface of the lock, the inner surface of the flexible reinforcing material surrounding the curved U-shaped portion of the main body portion of the lock and covering substantially the entire curved U-shaped portion of the main body portion of the lock;

a substantially U-shaped rigid reinforcement shield surrounding the inner surface of the flexible reinforcing material, the rigid reinforcement shield substantially conforming to the shape of the U-shaped portion of the main body portion of the lock and extending from below the folded edge of the flexible reinforcing material to the bottom surface of the lock, the rigid reinforcement shield including stepped portions extending toward the zipper end of the bag past the front surface of the main body portion of the lock; and means for connecting the rigid reinforcement shield and flexible reinforcing material to the main body portion of the lock.

8. A bag as claimed in claim 7 wherein the inner surface of the flexible reinforcement material has a pair of tapering front edges extending toward the front surface of the main body portion of the lock.

9. A bag as claimed in claim 7 wherein the folded edge of the flexible reinforcing material has two ends disposed past the front surface of the main body portion of the lock.

10. A bag as claimed in claim 7 wherein the rigid reinforcement shield includes a top edge and a pair of front edges perpendicular to the top edge, the top edge comprising a substantially U-shaped segment, angled segments extending from the U-shaped segment, and flat segments extending from the angles segments to the front edges, the flat segments covering a portion of the ledge.

* * * * *